United States Patent [19]

Fukasawa

[11] 4,064,035

[45] Dec. 20, 1977

[54] LEAD DIOXIDE ELECTRODE

[75] Inventor: Akira Fukasawa, Tokyo, Japan

[73] Assignee: Agency of Industrial Science & Technology, Tokyo, Japan

[21] Appl. No.: 711,498

[22] Filed: Aug. 4, 1976

[30] Foreign Application Priority Data

Aug. 7, 1975 Japan ..... 50-95414

[51] Int. Cl.[2] ..... C25B 11/16

[52] U.S. Cl. ..... 204/290 R; 204/290 F; 204/291

[58] Field of Search ..... 204/290 R, 290 F, 291, 204/57, 42; 429/228

[56] References Cited

U.S. PATENT DOCUMENTS

| | | | |
|---|---|---|---|
| 2,846,378 | 8/1958 | Hoffmann | 204/57 X |
| 3,819,414 | 6/1974 | Taylor | 429/228 X |
| 3,887,398 | 6/1975 | Singman | 429/228 |
| 4,008,144 | 2/1977 | Torkai et al. | 204/290 R |

*Primary Examiner*—F.C. Edmundson

*Attorney, Agent, or Firm*—Oblon, Fisher, Spivak, McClelland & Maier

[57] ABSTRACT

Disclosed is a novel lead dioxide electrode excellent in shock-resistance, chemical-resistance and electrical conductivity, which has as the electrode proper at least one set of double layer consisting of an $\alpha$-lead dioxide layer and a $\beta$-lead dioxide layer.

5 Claims, No Drawings

LEAD DIOXIDE ELECTRODE

BACKGROUND OF THE INVENTION

This invention relates to a novel lead dioxide electrode excellent in shock-resistance, corrosion-resistance and electrical conductivity and free from electrodeposition strain.

Conventional lead dioxide electrodes are used as electrodes in the electrolytic oxidation for the manufacture of halogenates. Efforts are now being continued to develop applications for lead dioxide electrodes to be used as electrodes in the electrolytic treatment of waste water or as anodes in the diaphragm-process electrolysis of sodium chloride.

The manufacture of lead dioxide electrodes has heretofore been carried out by an acidic electrodeposition process which uses lead nitrate, for example, as the electrolyte. This process causes lead dioxide to be electrodeposited on the substrate. The lead dioxide layer consequently formed on the substrate consists preponderantly of $\beta$-$PbO_2$. The layer, therefore, inevitably suffers electrodeposition strain, entailing the disadvantage that the layer itself may develop cracks or may break when the formed layer is peeled off the substrate.

For the purpose of obtaining an electrode having fastness high enough to withstand the electrodeposition stress productive of internal strain, attempts have been made to improve the shape of the substrate, the composition of the electrolyte, and various other electrolytic conditions including use of additives. Perfect elimination of the electrodeposition strain from the $\beta$-$PbO_2$ layer obtained by the electrolysis in an acidic bath is impossible. The electrodes of the type formed of such layer, therefore, are deficient in shock-resistance and leave much to be desired from the practical point of view.

An object of the present invention is to provide a lead dioxide electrode which is practically free from electrodeposition strain and is excellent in electrical conductivity, corrosion-resistance, chemical-resistance and shock-resistance.

Another object of this invention is to provide a lead dioxide electrode the manufacture of which is very easy.

SUMMARY OF THE INVENTION

To accomplish the objects described above, the lead dioxide electrode according to this invention has as the electrode proper at least one set of double layer which consists of an $\alpha$-lead dioxide layer and a $\beta$-lead dioxide layer.

The $\alpha$-lead dioxide layer, when electrodeposited under specific conditions, does not permit development of electrodeposition strain. By allowing the $\beta$-lead dioxide layer which excels in corrosion-resistance and electrical conductivity to be joined fast to said $\alpha$-lead dioxide, the electrodeposition strain possessed inherently by the $\beta$-lead dioxide layer is alleviated to such an extent that there is consequently obtained a lead dioxide electrode which is practically free from electrodeposition strain and is excellent in electrical conductivity and corrosion-resistance.

Furthermore, the process merely comprises the steps of electrodepositing an $\alpha$-lead dioxide layer and a $\beta$-lead dioxide layer in the order mentioned on a substrate by an ordinary technique of electrolysis and removing the substrate from the formed layer as occasion demands. The manufacture of the electrode of this invention is easy because it does not involve complicated steps of the conventional technique such as in causing a layer of lead dioxide to be electrodeposited on the inner wall surface of an iron cylinder and cutting segments of the layer off the wall surface.

The other objects and characteristics of the present invention will become apparent from the following detailed description of the invention.

DESCRIPTION OF THE PREFERRED EMBODIMENT

It has been an accepted belief that electrodeposition strain never fails to occur and persist in the lead dioxide layer and defies all attempts at elimination. The inventor made a devoted study on electrodeposition strain, electrical conductivity, corrosion-resistance, etc. with respect to $\alpha$-$PbO_2$ and $\beta$-$PbO_2$ layers. He has consequently acquired a knowledge that the $\alpha$-$PbO_2$ layer, though slightly inferior to the $\beta$-$PbO_2$ layer in corrosion resistance and electrical conductivity, excels in ability to adhere to the substrate, and that internal stress in the $\alpha$-$PbO_2$ layer causes the $\alpha$-$PbO_2$ layer to change its state continuously from tensile state (an outwardly bowed state wherein the strain is expansive) to compressive state (an inwardly bowed state wherein the strain is contractive) by proper selection of the electrolytic conditions, therefore, it is possible to find out certain sets of conditions of the variables under which no internal stress—namely no electrodeposition strain (an intermediary state wherein there is a complete absence of strain) —develops, and that, on the otherhand, the $\beta$-$PbO_2$ layer excels in corrosion resistance and electrical conductivity and enjoys high efficiency of manufacture but fails to enjoy freedom from electrodeposition strain. It has been ascertained that an electrode which suffers little from electrodeposition strain, exhibits shock-resistance of a sufficient degree from the pratical point of view and, what is more, electrical conductivity, corrosion-resistance and chemical-resistance which are important attributes for electrolysis can be obtained by causing these two layers to be electrodeposited one on top of the other in the form of an electrode proper so as to make the most of the characteristics inherent to the two layers. The present invention has been completed on the basis of this knowledge.

To be specific, this invention relates to a lead dioxide electrode which is comprised of at least one set of double layer consisting of an $\alpha$-$PbO_2$ layer and a $\beta$-$PbO_2$ layer formed on a substrate or of said set of double layer minus said substrate.

In each set of double layer in the electrode of the present invention, the $\alpha$-$PbO_2$ layer is desired to have a thickness of not less than 0.1 mm and the $\beta$-$PbO_2$ layer to have a thickness in the range between 0.2 and 1.0 mm. If the thickness of the $\alpha$-$PbO_2$ layer is less than the lower limit 0.1 mm, then the electrodeposition strain which develops in the $\beta$-$PbO_2$ layer cannot be completely alleviated and the pinholes which tend to occur in the $\alpha$-$PbO_2$ layer cannot be thoroughly eliminated. In this case, the characteristic properties of the electrode as a whole are scarecely improved and the phenomenon of electrodeposition strain alone is aggravated when the thickness of the $\beta$-$PbO_2$ layer is increased to more than 1.0 mm for the purpose of compensation. The combined thickness of one set of double layer is desired to be not less than 0.3 mm. The electrode fails to exhibit sufficient fastness if the combined thickness is less than 0.3 mm.

The exposed surface or active surface of the electrode may be that of either the $\alpha$-$PbO_2$ layer or the $\beta$-$PbO_2$ layer. In consideration of the fact that the $\beta$-$PbO_2$ layer excels the $\alpha$-$PbO_2$ layer in corrosion-resistance and electrical conductivity and the $\alpha$-$PbO_2$ layer exhibits a better ability to adhere to the substrate than the $\beta$-$PbO_2$ layer, it may be more practical to use the active surface of the $\beta$-$PbO_2$ layer.

The aforementioned double layer may be used in a state deposited on the substrate or it may be used as a complete electrode in a state stripped of the substrate. In either case, the electrode functions on entirely the same operating principle. It serves as an electrode which suffers little from electrodeposition strain and excels in corrosion-resistance and electrical conductivity.

The substrate to be used with the electrode of the present invention is not specifically limited. It is only desired to be of a substance such that it enjoys insolubility, electrical conductivity, light weight and ample fastness and exhibits an expansion coefficient approximating that of lead dioxide. Examples of substances which satisfy these requirements and which are inexpensive include graphite, titanium, iron and stainless steel.

The method by which the electrode of the present invention is manufactured will be described in full detail below.

Preparatory to the electrodeposition, the substrate is desired to undergo a pretreatment such as for removal of grease or rust. Where the $\alpha$-$PbO_2$ layer is first electrodeposited, such pretreatment may be omitted because the electrolyte is alkaline and consequently the electrodeposited layer exhibits satisfactory adhesiveness. Where the electrical conductivity is particularly required, the substrate is desired to undergo said pretreatment followed by a treatment for silver plating.

The conditions for electrodepositing $\alpha$-$PbO_2$ layer of the type free from the electrodeposition strain depend on the combination of such factors as the composition and concentration of the electrolyte and the density of positive electric current. Generally, the electrodeposition is carried out by passing an electric current in an electrolyte having a lead concentration of from 0.1 to 0.5 mol/liter and an alkali concentration of from 3 to 10N at a temperature in the range of from room temperature to 80° C, with the density of the positive current controlled in the range of from 1 to 5 A/dm$^2$. With the start of the passage of said electric current, the active surface side of the substrate begins to be coated with a film of lead dioxide. The electrodeposition is continued until the coat thus formed increases to a required thickness. At the end of the electrodeposition, the layer deposited on the substrate is washed with water and dried. The $\alpha$-$PbO_2$ layer thus formed on the substrate is free from electroposition strain and, therefore, may be safely dried by application of heat.

The electrodeposited layer thus obtained has a purplish black, partly glossy compact texture and exhibits fast adhesiveness. If the layer is formed to a thickness of 0.3 mm or more, it could then be used as an electrode complete in itself. If the thickness is so small as 0.1 to 0.2 mm, however, the layer may possibly suffer from occurrence of pinholes and therefore cannot be used safely in its unmodified form. Such a small thickness may suffice for this layer insofar as the $\beta$-$PbO_2$ layer is additionally electrodeposited thereon.

Then, the $\beta$-$PbO_2$ layer is electrodeposited on the $\alpha$-$PbO_2$ layer. This electrodeposition is effected by effecting an acidic electrolysis using as the electrolyte a concentrated solution of lead nitrate. To be specific, the acidic electrolysis is carried out in an aqueous 25% $Pb(NO_3)$ solution, for example, with the positive current density fixed in the range of from 5 to 10 A/dm$^2$ and the solution temperature held in the range of from 50° to 60° C. The electrodeposition liquid is desired to be used in a fluidic state. The spent liquid emanating from the electrodeposition bath may desirably be received in a neutralizing vessel to be completely neutralized with lead carbonate or lead hydroxide, for example, and returned in the neutralized state back to the electrodeposition bath for reuse.

In this electrolysis, the $PbO_2$ double layer of a thickness of the order of 2 to 3 mm can sufficiently be obtained in a matter of two to three hours because the electrolyte used has a high concentration and the positive current is used in a high density. The current efficiency for the formation of the $PbO_2$ layer is on a relatively high level of 83 to 85%. The electrodeposited $\beta$-$PbO_2$ layer has a purplish black color and a surface flecked with fine particles. Compact in texture, this layer enjoys a higher degree of fastness than the $\alpha$-$PbO_2$ layer (Martens' scratch hardness — 22 for $\beta$-$PbO_2$ layer and 20 for $\alpha$-$PbO_2$ layer).

Where the electrode is desired to be manufactured in a sheet-like form containing no substrate, it can be obtained by first electrodepositing on one surface of the substrate an $\alpha$-$PbO_2$ layer and then electrodepositing thereon a $\beta$-$PbO_2$ layer by following the procedure described above, subsequently repeating this cycles of operation to have additional $\alpha$-$PbO_2$ layers and $\beta$-$PbO_2$ layers electrodeposited alternately until the combined thickness of layer reaches a required value (about 10 mm), and thereafter separating the substrate mechanically by use of a cutter or, if the substrate happens to be made of iron, chemically dissolving out the substrate from the substrate by use of an acid.

In this case, a plate-shaped electrode which has a $\beta$-$PbO_2$ layer on either surface thereof can be obtained by carrying out the electrodeposition of alternating layers in such way that the first and last layers are both of $\beta$-$PbO_2$.

As described above, the electrode of the present invention is given at least one set of double layer consisting of an $\alpha$-$PbO_2$ layer and a $\beta$-$PbO_2$ layer by causing $\alpha$-$PbO_2$ layers and $\beta$-$PbO_2$ layers to be alternately electrodeposited one on top of the other. In the electrode thus produced, the $\alpha$-$PbO_2$ layer enjoys good adhesiveness to the substrate and freedom from electrodeposition strain. Moreover, since an alkali electrolyte is used for the electrodeposition of the $\alpha$-$PbO_2$ layer, the restrictions which would be imposed in the case of the acidic electrolysis on the selection of materials of substrate, electrolytic cell, etc. are substantially removed.

In the case of an electrode having the active surface (outermost layer) of $\beta$-$PbO_2$, since the $\beta$-$PbO_2$ layer excels the $\alpha$-$PbO_2$ layer in terms of corrosion-resistance and exhibits high electrical conductivity and has its inherent weak point of electrodeposition strain alleviated to some extent by the $\alpha$-$PbO_2$ layer, the electrode is notably improved in its characteristics in electrolysis so as to materialize savings of both production time and cost.

Lead dioxide electrodes have always drawn particular attention for their specific performances as anodes in the manufacture of hydrohalogen acid salts. Recently, they have been expected to find extensive utility in electrolysis of sodium chloride and in electrolytic disposal of waste water as well.

The present invention makes possible the manufacture of a lead dioxide electrode which suffers little from internal strain, exhibits notably improved fastness, electrical conductivity and corrosion-resistance and enjoys light weight, low cost and high practical utility. In addition to the uses mentioned above, the electrode of this invention is expected to find new applications such as in electrolytic metal refining, electrolytic floatation, electrolytic dialysis, etc.

Now the present invention will be described with reference to examples, which are cited solely for illustration and should be considered as limitations of the invention.

EXAMPLE 1

An electrolyte prepared by dissolving 80 g of lead hydroxide in 2 liters of an aqueous 5N caustic soda solution was placed in an electrolytic cell. In the electrolytic cell, a titanium electrode measuring 50 mm in length, 20 mm in width and 0.3 mm in thickness, as the anode, and two stainless steel sheets having dimensions identical with those of the anode, as the cathodes, were disposed at fixed intervals of 50 mm. With the electrolytic cell, the electrolysis was carried out for three hours, with the amperage fixed at 500 mA, the electrolytic bath temperature at 50° C and the bath voltage at 2.5 V respectively. The current efficiency was nearly 100%. After the electrolysis, the anode was washed with water to be freed completely from the alkali and measured for thickness. The measurement showed the thickness of the formed $\alpha$-$PbO_2$ layer to be 0.2 mm. On this anode, such phenomena as deformation due to inner strain and exfoliation of the formed $\alpha$-$PbO_2$ layer were not observed at all.

Subsequently, the electrode on which said $\alpha$-$PbO_2$ layer had been formed was used as the anode and two stainless steel sheets having the same dimensions were used as the cathodes. In an electrolytic cell containing 5 liters of an aqueous 25% lead nitrate solution, said electrodes were disposed. With this electrolytic cell, the electrolysis was carried out at a constant current for about 5 hours, with the anode current density fixed at 2 A/dm$^2$ and the electrolytic bath temperature at 60° C. This electrolysis was carried out by the reflux neutralization process, with a basic lead carbonate used as the neutralizing agent. The $\beta$-$PbO_2$ layer which had been electrodeposited on the surface of said anode had a purplish black color, a surface slightly flecked with fine particles and a thickness of 0.5 mm. The combined thickness of the $PbO_2$ double layer consisting of the $\alpha$-$PbO_2$ layer and the $\beta$-$PbO_2$ layer was about 0.7 mm.

In spite of such a small thickness, the $PbO_2$ layer did yield whatsoever to slight impacts. It enjoyed unusually high fastness and perfect freedom from discernible phenomena of cracks and exfoliation.

By way of performance test, the electrode thus obtained was subjected to electrolytic oxidation using potassium perchlorate.

The electrolysis was carried out in the absence of a diaphragm for about 10 hours by using a potassium chlorate solution with a concentration of 5 mols/liter as the raw solution and a stainless steel sheet as the cathode, with the bath temperature fixed at 15° C and the anode current density at 50 A/dm$^2$ respectively. The current efficiency for the formation of potassium perchlorate was found by this test to be about 87%.

The results indicate that the current efficiency obtained by the present electrode is about 5% higher than that obtained in the electrolysis carried out with the conventional plate-shape electrode composed mainly of a $\beta$-$PbO_2$ layer, that the evolution of heat during the electrolysis is much smaller despite the higher current density and that the phenomena such as change in the active surface and decay of the electrode proper were not observed at all.

EXAMPLE 2

A titanium lath measuring 50 × 150 mm was used as the anode and two copper sheets of the same size were used as the cathodes. In an electrolytic cell, these electrodes were disposed at fixed intervals of 20 mm. A liquid obtained by dissolving an excess amount of lead oxide in 5 liters of an aqeous 4N caustic soda solution so that the solution was supersaturated and the excess lead oxide sedimented at the bottom of solution was used as the electrolyte. In this electrolyte, an electric current was passed for 2 hours, with the anode current density fixed at 2.5 A/dm$^2$, the bath temperature at 40° C and the bath voltage at 1.2 V respectively. Consequently a rigid purplish black layer of lead dioxide was deposited to a thickness of 0.2 mm on the anode lath. This layer, when examined by X-ray diffraction, was identified to be pure $\alpha$-$PbO_2$.

On the $\alpha$-$PbO_2$ layer, the passage of electric current was continued for half an hour under virtually the same electrolytic conditions as those employed in the stage of $\beta$-$PbO_2$ layer production in Example 1 except that the anode current density was changed to 10 A/dm$^2$. Consequently there was formed a $\beta$-$PbO_2$ layer having a thickness of about 0.2 mm. Although pinholes occurred to some extent in the $\alpha$-$PbO_2$ layer, they did not interfere with the electrodeposition of the $\beta$-$PbO_2$ layer at all. While the current efficiency was 100% during the formation of the $\alpha$-$PbO_2$ layer, it was about 85% during the production of the $\beta$-$PbO_2$ layer.

The anode thus produced by the electrodeposition of the $\alpha$-$PbO_2$ layer and the $\beta$-$PbO_2$ layer was washed with water, dried at 60° C, and then subjected to electrodeposition first of an $\alpha$-$PbO_2$ layer and then of a $\beta$-$PbO_2$ layer over a total period of 5 hours. The thickness of the formed $\alpha$-$PbO_2$ layer was 0.2 mm and that of the $\beta$-$PbO_2$ layer was 0.5 mm.

By the procedure described above, there was obtained a multi-layer electrode which had two sets each of an $\alpha$-$PbO_2$ layer and a $\beta$-$PbO_2$ layer and had a combined thickness of 1.1 mm.

In a two-compartment electrolytic cell having an asbestos diaphragm, batchwise electrolysis of sodium chloride was carried out by using this electrode. The electrolysis was tried under varying combinations of conditions, with the anode current density selected from the range of 20 to 50 A/dm$^2$ and the temperature from the range of 20° to 70° C respectively. The results show that the current efficiency for the formation of caustic soda was from 85 to 90% and the wear of electrode from 0.06 to 0.5 gr/KAH in the catholyte. The values indicate that the electrode is amply suitable for the practical use.

EXAMPLE 3

By using as the substrate a graphite plate measuring 200 mm in length, 70 mm in width and 40 mm in thickness and by adopting the same conditions as used in the electrolysis for the $\beta$-$PbO_2$ layer deposition in Example 1, a $\beta$-$PbO_2$ layer of a thickness of about 1 mm was electrodeposited on one surface of said graphite substrate. On this $\beta$-$PbO_2$ layer, an $\alpha$-$PbO_2$ layer having a thickness of 1 mm was electrodeposited under the same conditions as those used in the electrolysis for deposition of the $\alpha$-$PbO_2$ layer in Example 1. The two stages of operation were repeated. The $PbO_2$ layer were examined to confirm that the layers were deposited fast on the substrate and they were free from possible cracks and exfoliation. Thereafter, a $\beta$-$PbO_2$ layer 3 mm in thickness, an $\alpha$-$PbO_2$ layer 2 mm in thickness and another $\beta$-$PbO_2$ layer 3 mm in thickness were electrodeposited to afford an electrode having a $PbO_2$ layer 12 mm in thickness electrodeposited thereon.

Then five grooves were cut in the graphite substrate by use of a thin-blade grinder to separate the $PbO_2$ layer from the substrate. Consequently, there was obtained a thin electrode containing no substrate.

The electrode thus obtained was observed to have substantially no internal strain. This electrode was not broken under slight impacts.

What is claimed is:

1. A lead dioxide electrode having at least one set of double layers consisting of an $\alpha$-lead dioxide layer of thickness not less than 0.1 mm and a $\beta$-lead dioxide layer of thickness not less than 0.2 mm as the outer layer.

2. A lead dioxide electrode according to claim 1, wherein said set of double layers is deposited on a substrate.

3. A lead dioxide electrode according to claim 2, wherein the $\alpha$-lead dioxide layer is deposited on the substrate.

4. A lead dioxide electrode according to claim 1, wherein the $\beta$-lead dioxide layer has a thickness in the range between 0.2 mm and 1.0 mm.

5. A lead dioxide electrode having at least one set of double layers consisting of an $\alpha$-lead dioxide layer of thickness not less than 0.1 mm and a $\beta$-lead dioxide layer of thickness not less than 0.2 mm and having the $\beta$-lead dioxide layers as the outer face of each double layer.

* * * * *